United States Patent [19]

Joern et al.

[11] Patent Number: 4,860,817

[45] Date of Patent: Aug. 29, 1989

[54] APPARATUS FOR THE COMPACTING OF GRANULAR MOLDING MATERIALS

[75] Inventors: Alfred Joern, Bibern, Switzerland; Wendelin Weimann, Klettgau, Fed. Rep. of Germany

[73] Assignee: Georg Fischer AG, Schaffhausen, Switzerland

[21] Appl. No.: 292,775

[22] Filed: Jan. 3, 1989

[30] Foreign Application Priority Data

Jan. 14, 1988 [CH] Switzerland ..... 00129/88

[51] Int. Cl.[4] ..... B22C 15/00

[52] U.S. Cl. ..... 164/169; 164/37

[58] Field of Search ..... 164/169, 37, 170, 171, 164/172, 173, 195, 201, 207, 38

[56] References Cited

U.S. PATENT DOCUMENTS 892,143 6/1908 Dupont ..... 164/37 X
3,143,775 8/1964 Jones ..... 164/37
3,238,575 3/1966 Taccone ..... 164/169
4,063,586 12/1977 Keller ..... 164/37 X
4,289,194 9/1981 Uzaki et al. ..... 164/173 X

FOREIGN PATENT DOCUMENTS 1263992 3/1968 Fed. Rep. of Germany ..... 164/37
55-103258 8/1980 Japan ..... 164/37

*Primary Examiner*—Nicholas P. Godici
*Assistant Examiner*—J. Reed Batten, Jr.
*Attorney, Agent, or Firm*—Bachman & LaPointe

[57] ABSTRACT

An apparatus for compacting granular materials comprises a rack having a pedestal for supporting the mold which contains the granular material to be compacted. A compacting mechanism for applying a compacting force to the granular material is mounted for vertical movement above the mold and is provided with a seal for sealing the mold when applying a compacting force to the granular molding material.

11 Claims, 2 Drawing Sheets

APPARATUS FOR THE COMPACTING OF GRANULAR MOLDING MATERIALS

BACKGROUND OF THE INVENTION

The invention relates to an apparatus for the compacting of granular molding materials and, more particularly, foundry molding materials.

Swiss Patent Specification No. 660,987 discloses an apparatus for compacting molding material wherein the molding means filled with molding material is transported on a lifting table which raises the molding means against an adaptor plate of a pressure chamber arranged on supports.

In the connection of granular foundry molding materials, a certain pressure level over the foundry material is necessary for the compacting operation in order to insure that the molding material is accelerated in the direction of the pattern or pattern plate carrier and its support. This pressure level P1 is applied by using a surge of compressed air, gas-explosion pressure or the like. After this first pressure level is withdrawn, a second reaction pressure P2 of about twice the level of the first pressure level P1 necessary for the acceleration is applied for further compacting the molding material, that is, $P2 \simeq 2P1$.

In the case of the apparatus according to Swiss Patent Specification No. 660,987, the contact force of the lifting table must correspond at least to the force of the second reaction pressure P2 in order to press the molding means against the compression or compacting means. A disadvantage in this arrangement is that the lifting table, the hydraulics and the machine rack have to be designed for these high forces. As a result, the apparatus has to be of a heavy duty and expensive design.

Accordingly, it is an object of the present invention to provide an apparatus for compacting granular molding material which overcomes the aforementioned disadvantages.

SUMMARY OF THE INVENTION

The foregoing object is achieved by way of the present invention wherein an apparatus for compacting granular molding materials contained in a molding means comprises a substantially U-shaped rack and a compacting means mounted on the rack for vertical movement thereon for applying a compacting force tot he granular material to be compacted. The compacting means is movable on the rack between a first loading position and a second compact force applying position. A seal is provided on the compacting means for sealing the molding means when the compacting means is in the second force applying position. In accordance with a particular feature of the present invention, a support pedestal is mounted on the rack in opposition to the compacting means and a transport system is provided for locating the molding means on the pedestal where the molding means is sealed when the compacting means is moved to the second impact force applying position.

Due to the direct supporting of the molding means on a supporting pedestal of the rack, the contact force of the compacting means against the molding means must only be as great as is necessary for the acceleration of the molding material as applied by pressure P1, therefore, a force of only half as great as the force actign in the frame of the above-mentioned Swiss patent is necessary.

In addition, due to the rigid supporting of the molding means on the supporting pedestal which acts as an anvil, the molding material compaction can be improved, as there is no longer any hydro-elasticity of a lifting table.

BRIEF DESCRIPTION OF THE DRAWINGS

The invention is described below with reference to exemplary embodiments and is represented in the accompanying drawings, in which.

DETAILED DESCRIPTION

Figure 1:
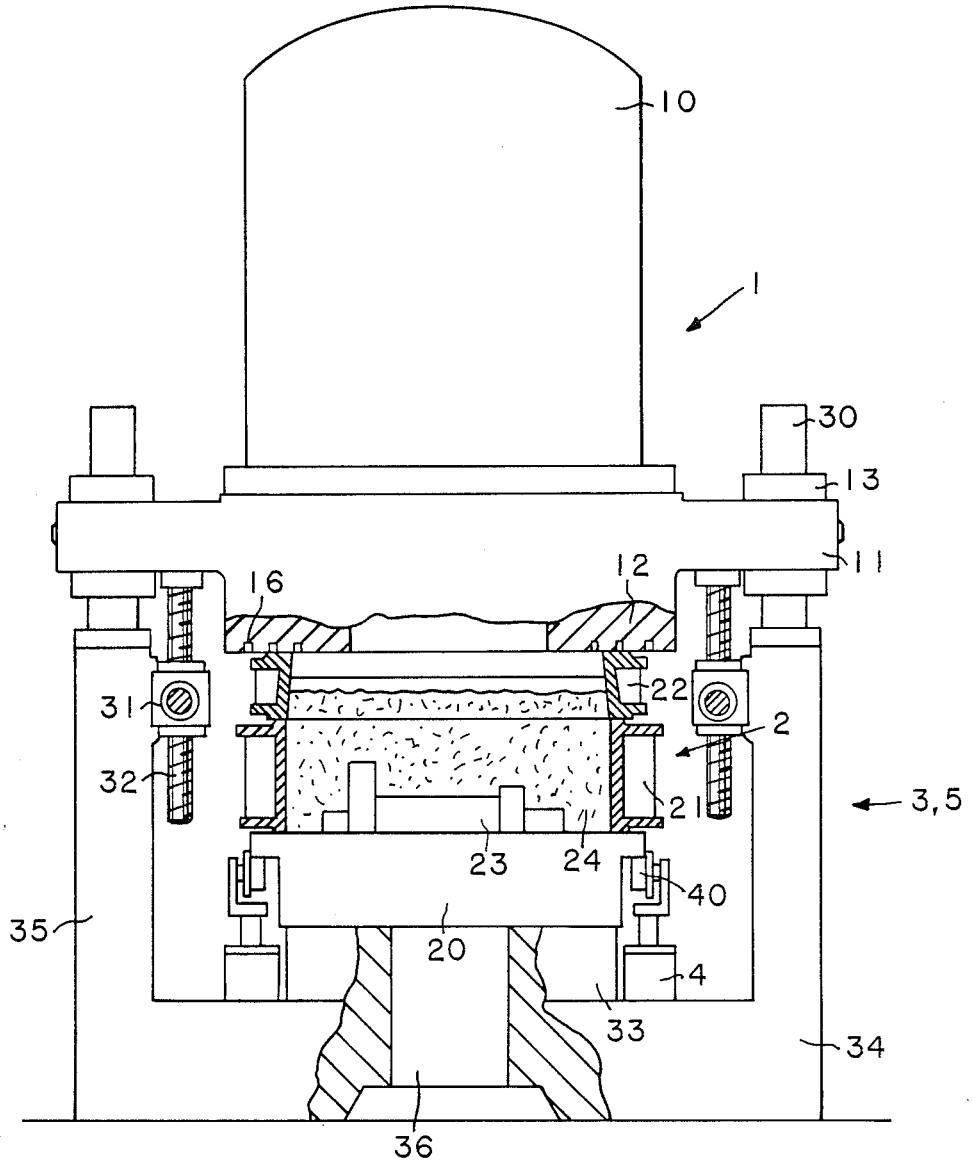
FIG. 1 shows a view, partially in section, of an apparatus for the compacting of granular molding materials.

The apparatus shown in FIG. 1 consists of a compacting means 1, a molding means 2, a rack 3 and a transporting means 4.

The compacting means 1 includes a pressure chamber or combustion chamber 10, which is designed in a manner well known in the art for the air-pulse method or for the gas-pressure molding method for applying pressure over the molding material. The pressure chamber or combustion chamber 10 is arranged on a supporting part 11, which is movably mounted in a vertical direction in column-like guides 30 of the rack 3. The supporting part 11 has a sealing plate 12 on its underside. On the sealing side of the sealing plate 12 there are arranged a plurality of longitudinally and transversely running sealing elements 16, which have a rectangular or square form in cross-section.

The compaction means 1 is vertically displaceable on the rack 3 and can be adjusted to differenct heights by means of raising and lowering means 31 arranged on the rack 3. In the exemplary embodiment shown according to FIG. 1, the raising/lowering means 31 has spindle drives 32, which can be driven by a motor. As a variant, hydraulic cylinders 15 may also be used for moving the compacting means 1 (FIG. 2), or, in special cases, stationary hoists may be employed.

On the supporting part 11 there are arranged clamping devices 13, by means of which the compacting means 1 can be connected firmly to the guides 30 of the rack 3.

The rack 3 has a supporting pedestal 33 for supporting the molding means 2. The pedestal 33 is rigidly connected to the vertical rack parts 35 by cross connections 34 of the substantially U-shaped rack 3. Consequently, with the compacting means 1 connected firmly to the guides 30 by clamping devices 13, a rigid enclosed frame 5 is produced which does not require any special foundations. For air removal from the molding means 2 the supporting pedestal is provided with at least one through-opening 36.

A transporting means 4 has transport rollers 40 on both sides of the supporting pedestal 33, which rollers are lowerable in known manner, either by a controllable actuating device or against the pressure of springs, neither of which are shown.

The molding means 2 consists of a pattern plate 20, on which the patterns 23 are arranged, a molding box 21 and a filling frame 22 fitted thereupon.

A metered quantity of molding material 24 is filled into the molding means 2 outside the rack and this is transported by means of the transporting means 4 over the supporting pedestal 33, where the molding means 2 is set down by lowering of the transport rollers 40. By lowering of the compacting means 1 by way of the raising and lowering means 31, the sealing plate 12 is set onto the filling frame 22 in a sealing manner and is subsequently connected firmly to the guides 30 by way of the clamping device 13.

Thereafter, the compacting of the molding material 24 takes place by a pressure surge during the expanding of the compressed air or by an exothermic reaction, as has already been described in Swiss Patent Specification No. 660,987 mentioned above. The compacting pressure acting on the pattern plate 20 is thereby absorbed directly by the supporting pedestal 33 of the rack 3.

After the raising of the compacting means 1, the complete molding means 2 is transported away by means of the transporting means 4, the filling frame 22 subsequently being lifted off in variuos stations and the molding box 21 with the compacted molding material separated from the pattern 23 and the pattern plate 20.

Figure 2:
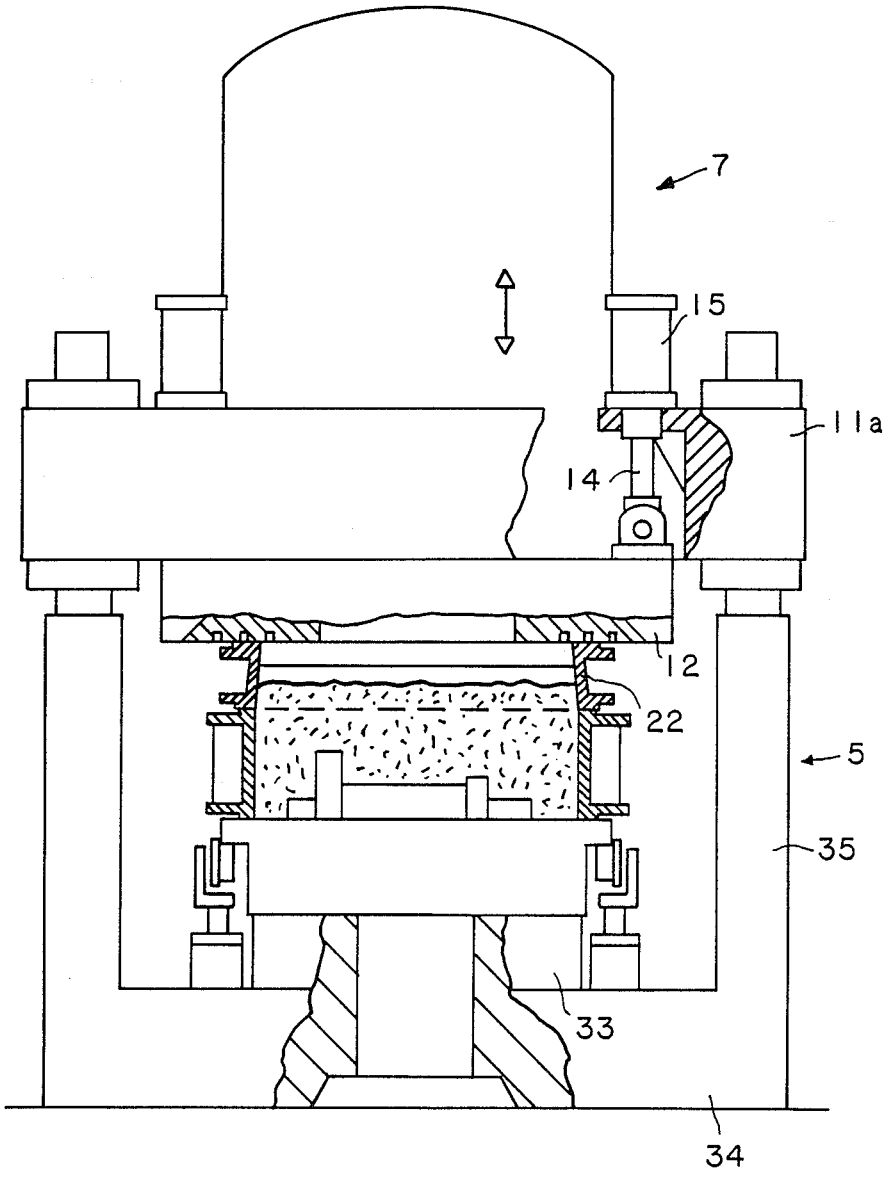
FIG. 2 shows a design variant of FIG. 1.

The apparatus shown in FIG. 2 differs only in the arrangement and design of the compacting means 1. The supporting part 11*a* of the compacting means is in the case firmly connected to the rack 3 and consequently likewise forms with the parts 33, 34, 35 a rigid, enclosed frame 5, the compacting means 1 is fastened on piston rods 14 of lifting cylinders 15 arranged in the supporting part 11*a* and can consequently be lowered onto the molding means 2 for a sealing support on the filling frame 22. The lowering of the compacting means 1 may also take place by the effective dead weight of the latter until the sealing plate 12 rests on the molding means 2 in a sealing manner. In this position, the compacting means 1 is then firmly connected to the rack 3. The raising of the compacting means 1 then takes place with the hydraulic cylinder 15 or with the raising/lowering means 31 of FIG. 1.

The design variant shown in FIG. 2 is advantageous whenever molding means 2 or molding boxes 21 of different heights are used.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for compacting granular molding material comprising: molding means for containing said granular molding material to be compacted; a rack; compacting means for applying a compacting force to said granular molding material in said molding means, said compacting means being mounted on said rack for vertical movement thereon between a first load position and a second compact force applying position; sealing means arranged on said compacting means for sealing said molding means when said compacting means is in said second position; a supporting pedestal mounted on said rack in opposition to said compacting means and transporting means for locating said molding means on said pedestal where said sealing means seals said molding means when said compacting means is in said second position.

2. An apparatus according to claim 1 wherein the compacting means is arranged vertically displaceably on guides of the rack and can be applied to the molding means in a sealing manner by means of a raising and lowering means.

3. An apparatus according to claim 2 wherein the raising and lowering means has a spindle drive.

4. An apparatus according to claim 2 wherein the raising and lowering means has hydraulic cylinders.

5. An apparatus according to claim 2 wherein the compacting means can be clamped firmly on the rack on the guides by way of clamping means.

6. An apparatus according to claim 1 wherein the transporting means has transport rollers on both sides of the supporting pedestal.

7. An apparatus according to claim 1 wherein the compacting means has a combustion chamber and the granular molding material is compacted by means of an exothermic reaction of a mixture of air and fuel.

8. An apparatus according to claim 1 wherein the compacting means has a pressure vessel and a pulsed-opening valve for compacting the granular molding material.

9. An apparatus according to claim 1 wherein the compacting means is connected to the molding means in a sealing manner by the effective dead weight thereof.

10. An apparatus according to claim 1 wherein said sealing means is provided with a plurality of longitudinally and transversely arranged sealing elements in rectangular or square form.

11. An apparatus according to claim 6 wherein said rollers are lowerable.

* * * * *